US009548561B2

(12) United States Patent
Marmonier

(10) Patent No.: US 9,548,561 B2
(45) Date of Patent: Jan. 17, 2017

(54) SYSTEM COMPRISING A BASE AND A HOT UNPLUGGABLE MODULE

(71) Applicant: Schneider Electric Industries SAS, Rueil Malmaison (FR)

(72) Inventor: Jean Marmonier, Saint Aunes (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 14/837,396

(22) Filed: Aug. 27, 2015

(65) Prior Publication Data

US 2016/0126666 A1 May 5, 2016

(30) Foreign Application Priority Data

Nov. 5, 2014 (FR) ..... 14 60677

(51) Int. Cl.
*H01R 13/66* (2006.01)
*H01R 13/629* (2006.01)
(Continued)

(52) U.S. Cl.
CPC ..... *H01R 13/629* (2013.01); *H01H 50/02* (2013.01); *H01H 50/048* (2013.01); *H01R 13/6683* (2013.01)

(58) Field of Classification Search
CPC ..... H05K 1/18; H05K 2201/10492; H05K 7/1427; H01H 47/325; H01H 71/125; H01H 35/146; H01H 71/123; H01H 71/08; H01H 50/048; H01H 50/02; H01R 12/716; H01R 2201/12; H01R 13/665; H01R 39/64; H01R 13/629; H01R 13/6683
(Continued)

(56) References Cited

U.S. PATENT DOCUMENTS 4,881,255 A * 11/1989 Neuwirth ..... H01T 4/06 337/29
5,576,676 A * 11/1996 Koller ..... H01H 50/047 335/132
(Continued)

FOREIGN PATENT DOCUMENTS

DE 89 10 805 U1 1/1991
EP 0 507 729 A2 10/1992
(Continued)

OTHER PUBLICATIONS

French Preliminary Search Report issued Jun. 23, 2015 in French Application 14 60677, filed on Nov. 5, 2014 ( with English Translation of Categories of Cited Documents).

*Primary Examiner* — Adam B Dravininkas
(74) *Attorney, Agent, or Firm* — Oblon, McClelland, Maier & Neustadt, L.L.P.

(57) ABSTRACT

A system including a base and a module to be inserted into this base, an electric relay to electrically disconnect the module from the base, and a blocking device that can change over from a blocking state to a release state. The system including a sensor to detect the presence of the module in the base and a blocking sensor to detect the state of the blocking device, and means for opening the relay as soon as the blocking device is released or as soon as the module is not present. The blocking device can leave its released state only when the module has been extracted from the base by a distance more than the detection distance of the presence sensor.

8 Claims, 3 Drawing Sheets

(51) Int. Cl.
*H01H 50/02* (2006.01)
*H01H 50/04* (2006.01)

(58) Field of Classification Search
USPC ..... 361/728, 730–733, 736, 740–742, 747
See application file for complete search history.

(56) References Cited

U.S. PATENT DOCUMENTS

| | | | | | |
|---|---|---|---|---|---|
| 6,128,198 | A * | 10/2000 | Kurrer | H05K 7/1409 | 200/292 |
| 6,944,029 | B1 * | 9/2005 | Marcolina | H05K 7/1409 | 361/732 |
| 7,435,113 | B2 * | 10/2008 | Cheng | H01R 13/6295 | 439/157 |
| 7,510,416 | B2 * | 3/2009 | Sato | H05K 7/1409 | 361/754 |
| 2013/0323940 | A1 * | 12/2013 | Coffey | G02B 6/36 | 439/38 |

FOREIGN PATENT DOCUMENTS

| | | |
|---|---|---|
| EP | 2 626 879 A1 | 8/2013 |
| WO | WO 98/05052 | 2/1998 |

* cited by examiner

SYSTEM COMPRISING A BASE AND A HOT UNPLUGGABLE MODULE

TECHNICAL FIELD

The invention relates to a system comprising a base and a module that is inserted into this base mechanically to be electrically connected to it, while it can be removed from this base to be disconnected from it without any risk, even if this removal is not preceded by switching the power off.

STATE OF PRIOR ART

Such an unpluggable module comprises a set of electrical contacts and can be used to supply power to one or several electrical receivers from a base provided for this purpose, for example to create a 200 volt power supply with an intensity of up to 10 A.

Such a module is equipped with electric relays controlled by an external system through a data bus, each relay thus being used to connect or disconnect the electricity power supply of an electrical receiver powered through the base to which this module is connected.

Thus, before such a module is removed, the relays concerned have to be ordered to open so as to switch off the electricity power supply to the module before unplugging it to prevent the occurrence of an electric arc.

Nevertheless, if the module is removed from service and for any reason whatsoever its relays were not opened, this removal can cause an electric arc between the contacts of the module and the contacts of the base, which can reduce safety in using such a system.

The purpose of the invention is to disclose a solution to make the module of such a system unpluggable when hot with no risk.

PRESENTATION OF THE INVENTION

To achieve this, the purpose of the invention is a system comprising a base and a module that can be inserted into this base to be electrically connected with this base, an electric relay that can be opened or closed to decouple the module from the base or to couple it to the base respectively, a mechanical blocking device changing over from a blocking state to a release state that an operator can actuate to release the module in order to extract it from the base, this system comprising a sensor to detect the presence of the module in the base and a blocking sensor to detect the state of the blocking device, and means for opening the relay as soon as the blocking sensor detects that the blocking device is in the released state or as soon as the presence sensor detects that the module is not present in the base, the blocking device being arranged so that it can leave its released state only when the module has been extracted from the base by a distance more than the detection distance of the presence sensor.

With this arrangement, the module is disconnected as soon as the operator begins to release it, and there is no risk that it will be reconnected as it is removed from the base.

The invention also relates to a system thus defined in which the blocking device and each relay are built into the module.

The invention also relates to a system thus defined in which the blocking device comprises a lever elastically returned to its blocking state, this lever being provided with a stud that can fit into a corresponding housing made in the base to block the module, the length of this stud along the displacement direction of the module in the base being more than the detection distance of the presence sensor.

The invention also relates to a system thus defined, comprising a return element of the lever applying an elastic return force on a free end of this lever to continually tend to return it towards its blocking position.

The invention also relates to a system thus defined in which the sensors are Hall effect type sensors.

The invention also relates to a system thus defined comprising at least one Hall effect type sensor.

The invention also relates to a system thus defined, comprising at least an electrical contactor type sensor.

The invention also relates to a system thus defined, comprising at least one Hall effect type sensor and at least one electrical contactor type sensor.

The invention also relates to a system thus defined, comprising two sensors supported on a single printed circuit that is included in the module.

DETAILED PRESENTATION OF PARTICULAR EMBODIMENTS

The basic idea of the invention is to integrate a module blocking sensor and a module presence sensor in the system formed by the module and its base, with an electric relay controlled by these sensors to open when releasing occurs or when it is detected that no module is present, and to make sure that the blocking sensor cannot return to the blocking state before the presence sensor begins to detect absence of the module.

In the example described below, the invention is implemented on a module equipped with a relay, but a single module can equally well be fitted with several relays.

Figure 1:
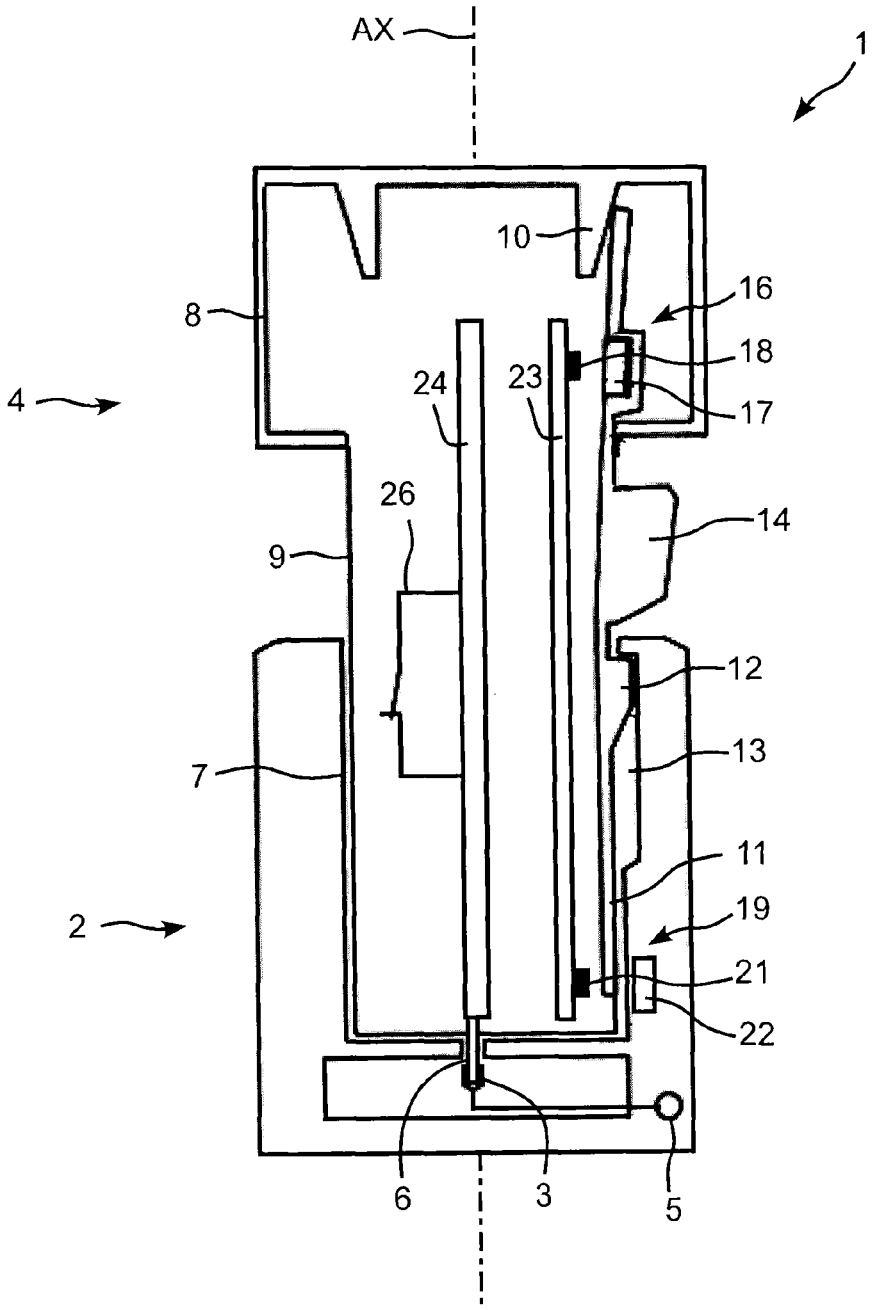
FIG. 1 shows a sectional view of the base with the module engaged and blocked in this base so that they are electrically connected to each other.

The system according to the invention that is shown as mark 1 in FIG. 1 comprises a base 2 equipped with an electric contact 3 and a module 4 equipped with another electric contact 6, the module 4 possibly being plugged into the base to be electrically connected to it.

As can be seen in the figure, the shape of the base is hollow delimiting a cavity 7 that is generally parallelepiped in shape extending along a longitudinal axis AX to form the female element. The module comprises a cover 8 supporting a body 9 with a generally parallelepiped male shape that will engage in the cavity 7 of the base while moving parallel to and along the AX direction.

The electric contact 6 is located at the free end of the body 9 projecting beyond this end, while the electric contact 3 is located in the bottom of the cavity 7 and is connected to a terminal 5 at which the base is connected to a cable.

The body 9 of the module is a plastic or metal element including several electrical components and is equipped with a mechanical blocking device 11. In this case this mechanical blocking device is a flexible lever that longitudinally covers a portion of the body 9 extending along the AX direction.

This flexible lever 11 comprises an end at which it is rigidly fixed to the free end of the body 9 and an opposite free end located close to the cover 8. This other end is free to move towards or away from the body 9.

This lever 11 that continuously tends to move away from the body 9 comprises a blocking stud 12 that projects away from the AX axis in the radial direction. When the module 4 is in the cavity 7 and the lever 11 is released, the stud 12 is engaged in a corresponding recess 13 formed in an internal side flank of the cavity 7 to retain this body 9 in the base.

As can be seen in FIG. 1, the free end of the lever 11 is held in place by an internal stud in the cover 8 mark 10, that continuously applies a return force on this free end tending to return it to its blocking state.

This lever 11 also comprises a button 14 that projects radially like the stud, but that is located between the base 2 and the cover 8 of the module 4 in position in the base.

In this situation that corresponds to the situation in FIG. 1, an operator can press the button 14 of the lever 11 to bring it into contact with the body 9 so as to release the stud 12 from the recess 13 so as to release the body 9 so that it can be removed.

The module 4 comprises a blocking sensor 16 that is sensitive to the position of the lever 11. This blocking sensor 16 determines if this lever 11 is in a locking or blocking state or if on the other hand it is in a release state. In the locking state corresponding to FIG. 1, the free end of the lever 11 is moved away from the body 9, while in the release state, the free end of this lever is close to the body 9.

In this case the blocking sensor 16 comprises a permanent magnet 17 installed in the end of the lever 11, and a Hall effect probe 18 installed in the body 9 facing this permanent magnet. This blocking sensor 16 detects that the lever is in a blocking state when the permanent magnet contained in it is at a distance from the Hall effect probe. On the contrary, it detects that this lever is in the release state when its permanent magnet is close to the Hall effect probe.

The system is also provided with a presence sensor 19 that detects whether the module 4 is present or absent in the base 2. This sensor comprises also a permanent magnet 22 installed in the bottom of the base 2 and a Hall effect probe 21 installed at the end of the body 9 facing the magnet 22 when the module is in the base.

The presence sensor detects that the module is in the base when its Hall effect probe 21 detects the presence of the permanent magnet 22, and it detects that the module 4 is outside the base 2 when the permanent magnet 22 is no longer detected by the probe 21, in other words when it is beyond the detection distance of the probe 21.

As shown diagrammatically in FIG. 1, the two Hall effect probes 18 and 21 are supported on a single printed circuit 23 housed inside the body 9.

This body 9 also comprises another printed circuit mark 24 that supports an electric relay 26. This other printed circuit 24 and the relay 26 that it supports are connected firstly to an electricity power supply cable of the module not shown, and secondly to the contact 6 of the module 4. The contact 6 is thus electrically powered when the relay 26 is electrically closed, and on the other hand it is disconnected when this relay 6 is open. The relay 26 can thus uncouple the module from the base when it is electrically open, and couple the module to the base when it is electrically closed.

The relay 26 is controlled by components not shown so that it is open if the blocking sensor 16 detects that the device 11 is in a release state or if the presence sensor 19 detects that the body 9 is not in the base 2. In other words, the electric relay 26 is controlled so that it is electrically closed only if the sensor 16 detects that the device 11 is in a blocking state and that the presence sensor 19 detects that the body 9 is in the base 2.

Furthermore, the stud 12 and the groove 13 are designed considering the sensitivity of sensors 16 and 19 such that when the module is removed after pressing on the lever 11, releasing the lever and subsequent detection of the blocking state by the sensor 16 only takes place when the presence sensor 19 has detected that the conductor 9 is not in the base.

In other words, the length of the stud 12 along the AX axis is sufficient such that during removal, the lever 11 cannot be released into its blocking position until after a movement distance such that the sensor 19 necessarily detects that the module is not in the base.

The length of the stud 12 is thus more than the detection distance of the presence sensor 19 along the AX direction, the housing 13 having approximately the same length along the AX axis.

The result obtained is thus an overlap between the state change of the blocking sensor and the state change of the presence sensor: during removal, there is no risk that the release sensor will return to the blocking state before the presence sensor begins to detect that the module is missing.

Furthermore and as will have been understood, each electric relay 26 is sized and designed so that its breaking capacity is sufficient to interrupt the nominal current of the system, while the contacts 3 and 6 are not designed to resist a break at the nominal current of the system due to their separation, without being damaged.

When the operator would like to disconnect the module 4 during operation, he presses the button 14 to move it towards the body 9, which has the effect of mechanically releasing the module 4 from the base in which it is plugged.

Figure 2:
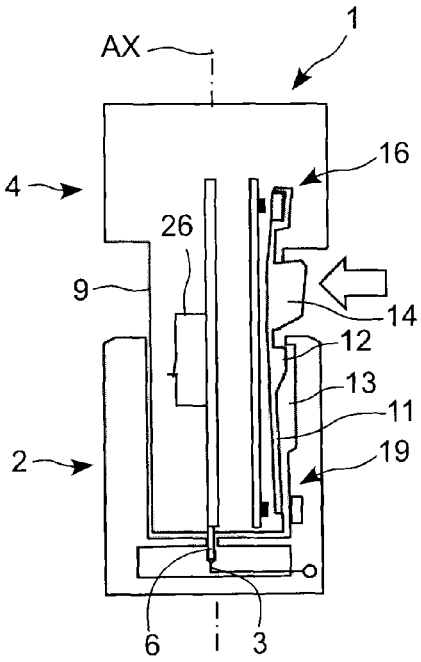
FIG. 2 shows a sectional view of the base with the module engaged in this base while it is being released ready for removal.
Figure 3:
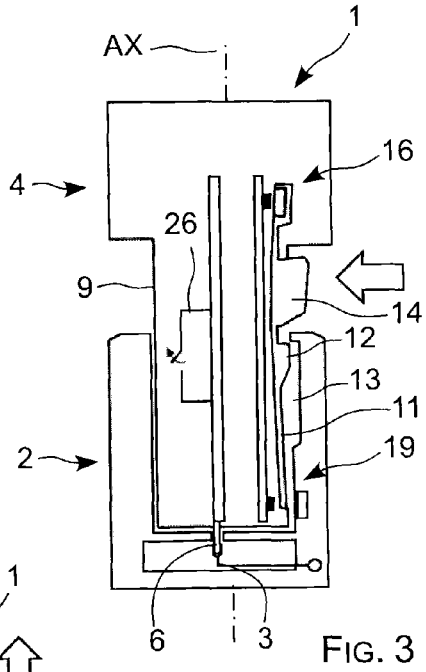
FIG. 3 shows a sectional view of the base with the module engaged in this base but completely released ready for removal.

At this stage corresponding to the stage shown in FIG. 2, the blocking sensor 16 detects that the lever 11 is in a release state and it sends a corresponding signal to a control unit of the relay 26 that controls opening of this relay, if it was in the closed state to supply power to the electrical receiver.

Figure 4:
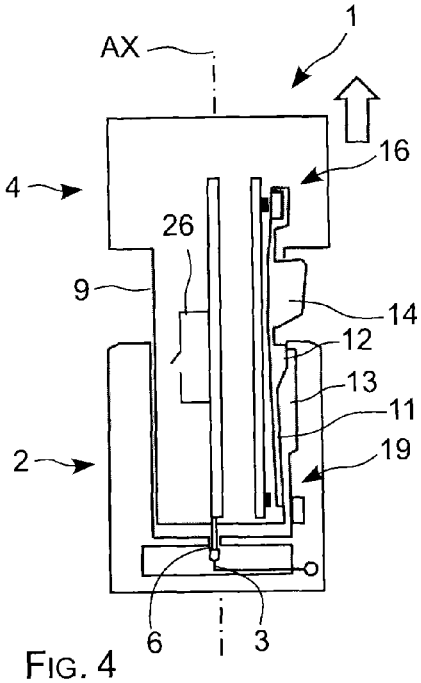
FIG. 4 shows a sectional view of the base with the module engaged in this base at the beginning of removal and the blocking device that is held in the release position.
Figure 5:
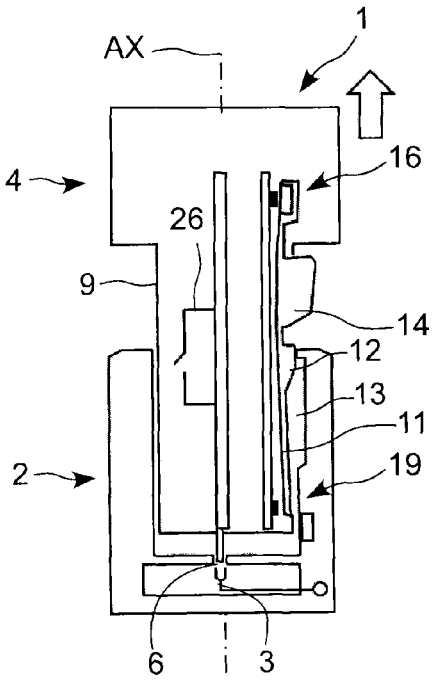
FIG. 5 shows a sectional view of the base and the module while it is being removed from this base with the blocking device held in the release position.

Electric current then no longer passes in the module and through the contacts 3 and 6, which authorises the beginning of removal of the module 4 from the base 2 as shown in FIG. 2, without an electric arc occurring between contacts 3 and 6. The operator continues to move the module 4 away from the base 2, corresponding to the situation shown in FIGS. 4 and 5.

The presence sensor 19 changes state at some time during this phase beginning removal of the module, to detect that the module is not in the base, which causes this sensor to send a corresponding signal to the control unit of the electric relay 26 not shown.

Figure 6:
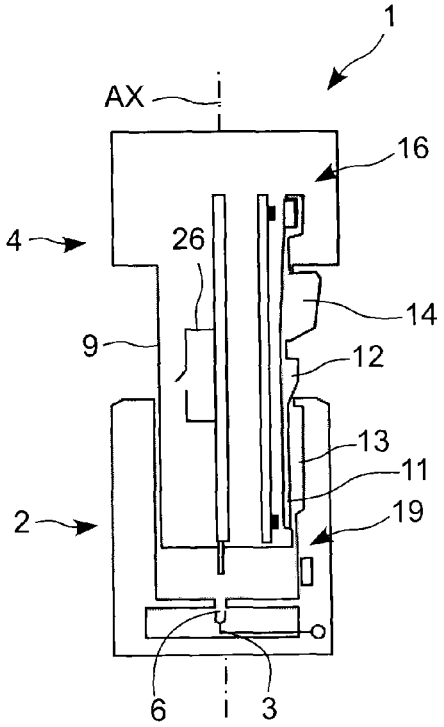
FIG. 6 shows a sectional view of the base and the module being removed once the electric contacts have separated and the blocking device has returned to its blocking position.

Removal of the module then continues until the state shown in FIG. 6 is reached in which the blocking stud is located entirely outside the base 2, such that it is no longer retained by the base. If the operator releases pressure on the button 14 at this stage, the lever 11 moves away from the body 9 such that the sensor 16 detects a release state and sends a corresponding signal to the control unit of the electric relay 26. Since this control unit continues to receive an absence signal from the sensor 19, it continues to control the relay 26 so that it remains electrically open. The operator can continue to remove the module without any electricity risk.

Conversely, as will have been understood, when the operator inserts the module 4 into the base 2, the relay 26 is initially opened and the sensors 19 and 16 change state one after the other during insertion. When the blocking sensor 16 sends a blocked state detection signal to the control unit and the presence sensor 19 sends a module presence detection in the base 2 signal to this unit, this unit controls closing of the relay 26 so that current can pass in the body 9 and subsequently in contacts 3 and 6.

In the example in the figures, the module comprises a single blocking lever 11, but the system could include several blocking devices, for example a lever on each side of the body. The presence sensor and the blocking sensor may be Hall effect sensors as shown in the example in the figures but they could also be any type of appropriate sensors for example such as electrical contactor type sensors.

In general, the reaction time of the sensors to control the relay is sufficiently short, typically of the order of 10 milliseconds, so that the operator cannot remove the module fast enough for the contact separation to take place before the relay is opened.

The invention is capable of detecting unplugging by combining the blocking sensor and the presence sensor with a design such that during removal, the lever remains in the release state as long as the presence sensor detects that the module is in the base.

The invention applies to the case in which the module is designed to transfer electrical power, but it is also applicable to an external signal or data acquisition module. For signal acquisition, the signal output from the module release and presence sensor can disable all signal acquisition before effective separation of the electrical contacts so that there is no incorrect transmission.

The invention claimed is:

1. A system comprising a base and a module that can be inserted into said base to be electrically connected with this base, at least one electric relay that can be opened or closed to decouple the module from the base or to couple said module to the base respectively, a mechanical blocking device changing over from a blocking state to a release state that an operator can actuate to release the module in order to extract the module from the base, said system comprising a sensor to detect the presence of the module in the base and a blocking sensor to detect the state of the blocking device, and a device for opening the relay as soon as the blocking sensor detects that the blocking device is in the released state or as soon as the presence sensor detects that the module is not present in the base, the blocking device being arranged so that the blocking device can leave its released state only when the module has been extracted from the base by a distance more than the detection distance of the presence sensor.

2. The system according to claim 1, in which the blocking device and each relay are built into the module.

3. The system according to claim 2, in which the blocking device comprises a lever elastically returned to its blocking state, said lever being provided with a stud that can fit into a corresponding housing made in the base to block the module, the length of this stud along the displacement direction of the module in the base being more than the detection distance of the presence sensor.

4. The system according to claim 3, comprising a return element of the lever applying an elastic return force on a free end of this lever to continually tend to return the lever towards its blocking position.

5. The system according to claim 1, comprising at least one Hall effect sensor.

6. The system according to claim 1, comprising at least an electrical contactor sensor.

7. The system according to claim 1, comprising at least one Hall effect sensor and at least one electrical contactor sensor.

8. The system according to claim 1, comprising two sensors supported on a single printed circuit that is included in the module.

* * * * *